US010730731B2

(12) United States Patent
Eiler

(10) Patent No.: US 10,730,731 B2
(45) Date of Patent: Aug. 4, 2020

(54) FORKLIFT MAST WARNING ALARM

(71) Applicant: John Eiler, Milltown, IN (US)

(72) Inventor: John Eiler, Milltown, IN (US)

( * ) Notice: Subject to any disclaimer, the term of this patent is extended or adjusted under 35 U.S.C. 154(b) by 0 days.

(21) Appl. No.: 16/402,945

(22) Filed: May 3, 2019

(65) Prior Publication Data

US 2020/0031646 A1 Jan. 30, 2020

Related U.S. Application Data

(60) Provisional application No. 62/703,668, filed on Jul. 26, 2018.

(51) Int. Cl.

| | |
|---|---|
| ***H01H 9/00*** | (2006.01) |
| ***B66F 17/00*** | (2006.01) |
| ***G08B 3/06*** | (2006.01) |
| ***G08B 3/10*** | (2006.01) |
| ***B66F 9/075*** | (2006.01) |

(52) U.S. Cl.

CPC ..... *B66F 17/003* (2013.01); *B66F 9/07504* (2013.01); *G08B 3/06* (2013.01); *G08B 3/10* (2013.01)

(58) Field of Classification Search

CPC ..... B66F 17/003; B66F 9/07504; G08B 3/06; G08B 3/10

See application file for complete search history.

(56) References Cited

U.S. PATENT DOCUMENTS 4,680,571 A * 7/1987 Keklak ..... B60Q 1/52 340/463
5,011,358 A * 4/1991 Andersen ..... B66F 9/0755 187/222
6,069,558 A 5/2000 Kershaw
7,081,812 B2 7/2006 Hastings
7,287,625 B1 10/2007 Harris
8,003,902 B1 * 8/2011 Cannella ..... B60Q 1/46 200/1 B
2003/0024132 A1 * 2/2003 Kokura ..... B66F 17/003 33/712
2009/0114485 A1 * 5/2009 Eggert ..... B66F 9/07545 187/394
2009/0303035 A1 12/2009 Kirtley, Jr.
2010/0176922 A1 * 7/2010 Schwab ..... G06K 7/10356 340/10.1
2012/0272923 A1 * 11/2012 Stephens ..... A01K 15/021 119/719
2016/0376135 A1 12/2016 Kim
2019/0047470 A1 * 2/2019 Thompson ..... B62D 1/06

* cited by examiner

*Primary Examiner* — Munear T Akki

(74) *Attorney, Agent, or Firm* — Boudwin Intellectual Property; Daniel Boudwin

(57) ABSTRACT

A forklift mast warning alarm including a horn bar configured to be movably attached to a contact bar. A plurality of pressure sensors vertically affixed along a lower surface of the horn bar, wherein the sensors keep the horn bar from contacting the contact bar until pressure is applied. At least one electrical contract movably disposed in the horn bar. A spring disposed around the electrical contacts for allowing the electrical contacts to move bias the horn bar away from the contact bar until pressure is added. A noise making device attached to the horn bar. Horn circuitry configured to activate the noise making device when the at least one electrical contact disposed on the underside of the horn bar comes in contact with the at least one electrical contact disposed along contact bar.

11 Claims, 4 Drawing Sheets

FORKLIFT MAST WARNING ALARM

CROSS REFERENCE TO RELATED APPLICATIONS

This application claims the benefit of U.S. Provisional Application No. 62/703,668 filed on Jul. 26, 2018. The above identified patent application is herein incorporated by reference in its entirety to provide continuity of disclosure.

BACKGROUND OF THE INVENTION

Companies all over the world use forklifts as a manner of lifting and storing objects in warehouses or stores. In some instances, these forklifts can lift items well above the height at which a person has adequate depth perception. This can mean that operating a forklift can be an extremely difficult and dangerous process. When stacking products, it is often much safer to use a set of preconstructed shelves. The forklift mast may accidentally contact a ceiling or storage rack, causing extensive damages.

Despite trying to be safe and careful, operators may make mistakes and may accidentally cause the mast to collide with surrounding objects. If the mast contacts a person, serious injury could occur for the person and the operator of the forklift. This can cause the objects to fall from the shelves or forklift, sending them crashing to the ground. Further, due to the power of a forklift the shelving can be bent or damaged if hit by a forklift.

Consequently, there is a need in for an improvement in the art of forklift warning devices. The present invention substantially diverges in design elements from the known art while at the same time solves a problem many forklift operators face. In this regard the present invention substantially fulfills these needs.

SUMMARY OF THE INVENTION

In view of the foregoing disadvantages inherent in the known types of forklift warning systems now present in the prior art, the present invention includes a horn bar configured to be movably attached to a contact bar. The horn bar is configured to have pressure applied to a top section thereof. A series of pressure sensors and springs are connected to the underside of the horn bar configured to bias the horn bar away from the contact bar. When pressure is applied to the horn bar it is moved toward the contact bar, a plurality of electrical contacts disposed within the horn bar come in contact with a surface designed to complete an electrical circuit. Once the electrical circuit is completed a horn device is configured to sound. This will alert a forklift operator that pressure has been applied to the forklift mast warning alarm.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
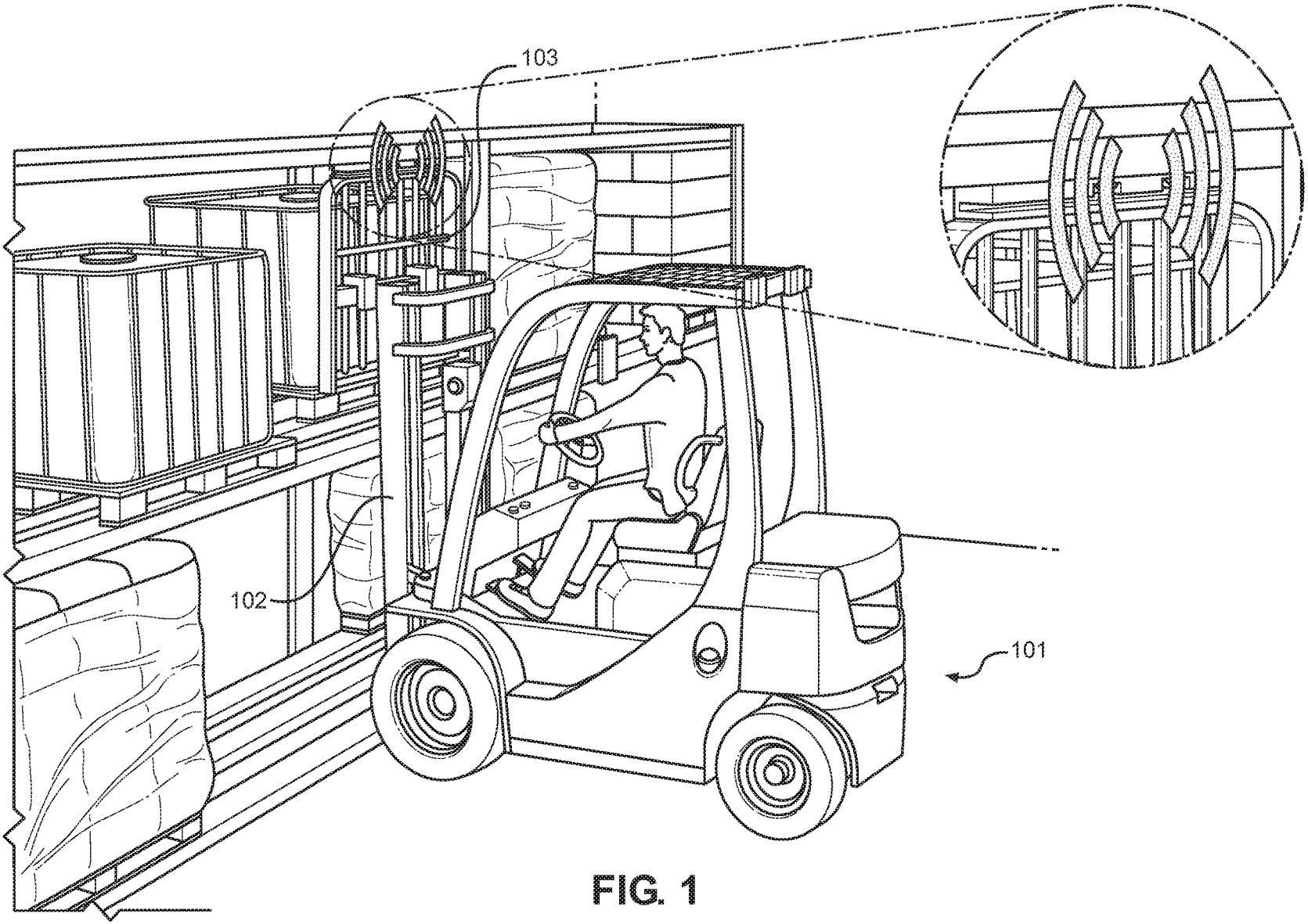
FIG. 1 shows a perspective view of an embodiment of the forklift mast warning alarm in use.

Reference is made herein to the attached drawings. Like reference numerals are used throughout the drawings to depict like or similar elements of the forklift mast warning alarm. For the purposes of presenting a brief and clear description of the present invention, a preferred embodiment will be discussed as used for the forklift mast warning alarm. The figures are intended for representative purposes only and should not be considered to be limiting in any respect.

Referring now to FIG. 1, there is shown a perspective view of an embodiment of the forklift mast warning alarm in use. The forklift 101 has a mast 102 and an attached guard 103. The forklift mast warning alarm is attached to a top side of the guard 103. In use when the forklift 101 places an article on a high shelf it can be difficult to tell where the guard 103 is located. The forklift mast warning alarm will sound if pressure is applied due to the forklift 101 hitting the shelf.

Figure 2:
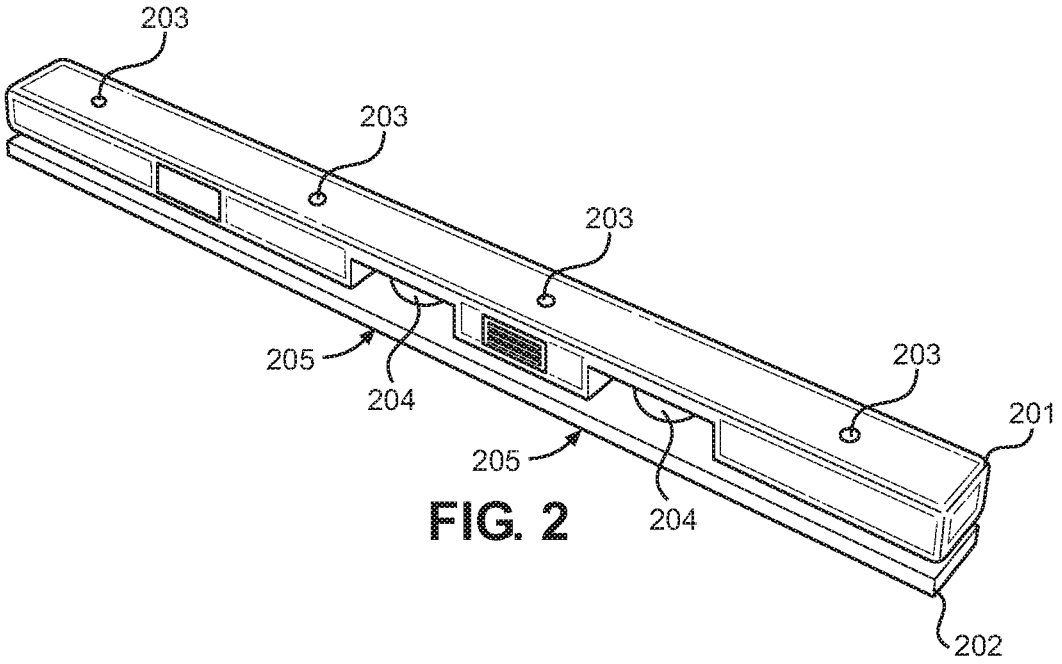
FIG. 2 shows a perspective view of an embodiment of the forklift mast warning alarm.

Referring now to FIG. 2, there is shown a perspective view of an embodiment of the forklift mast warning alarm. The forklift mast warning alarm has two bars. A horn bar 201 is the top bar. The horn bar 201 is attached to a contact bar 202. The contact bar 202 is a flat bar. The horn bar 201 is attached to the horn bar such that it can move from a starting position toward the contact bar 202 and back to the starting position again. In one embodiment this connection can be done using a series of bolts. The bolts will be placed through the contact bar 202 and the horn bar 201. Nuts will be placed on the bolts leaving room for the horn bar 201 to move.

The contact bar 202 is further securely attached to the forklift guard. In one embodiment the contact bar 202 is configured to accept straps there along to attach the forklift guard. In another embodiment there are clips attached to the contact bar. The clips are designed to hang down below the contact bar. In one embodiment the clips are an L shaped bracket. The bottom of the clip is bent inward to create pressure holding the forklift mast warning alarm in place. The clips are configured to have a bar of the forklift guard placed between a bottom of the clip and the bottom of the contact bar. In one embodiment the contact bar 202 is made out of wood. In another embodiment the contact bar 202 is made out of plastic. In yet another embodiment the contact bar 202 is made from any other suitable materials.

The horn bar 201 has a plurality of contacts 203 placed therein. The contacts 203 should be capable of transmitting electric current. In one embodiment the contacts 203 may be screwed into the horn bar. In another embodiment the contacts 203 are placed through the horn bar 201 and pins are used to keep the contacts 203 in place in the horn bar 201. In one embodiment the contacts 203 are metal rods.

The horn bar 201 has a series of pressure sensors 204 disposed thereon. In one embodiment the pressure sensors are air bag sensors. In another embodiment the pressure sensors are hydraulic. In one embodiment the horn bar 201 has cut outs 205. These cut out 205 are configured to accept the pressure sensors 204 therein. The pressure sensors 204 are configured to extend past the bottom surface of the horn bar 201. This configuration of the pressure sensors 204 will keep the horn bar 201 from contacting the contact bar 202 until pressure is applied.

In one embodiment the horn bar 201 has a beveled top. In one embodiment the beveled top is rounded in a semi-circle. In another embodiment the horn bar 201 has an angled top. In one embodiment the angled top may only be angled in one direction. In another embodiment the angled top may be triangular. This will allow the horn bar 201 to be depressed if a pressure is applied from a different angle other than straight down. In one embodiment the horn bar 201 is made out of wood. In another embodiment the horn bar 201 is made out of plastic. In yet another embodiment the horn bar 201 is made from metal or any other suitable materials.

Figure 3:
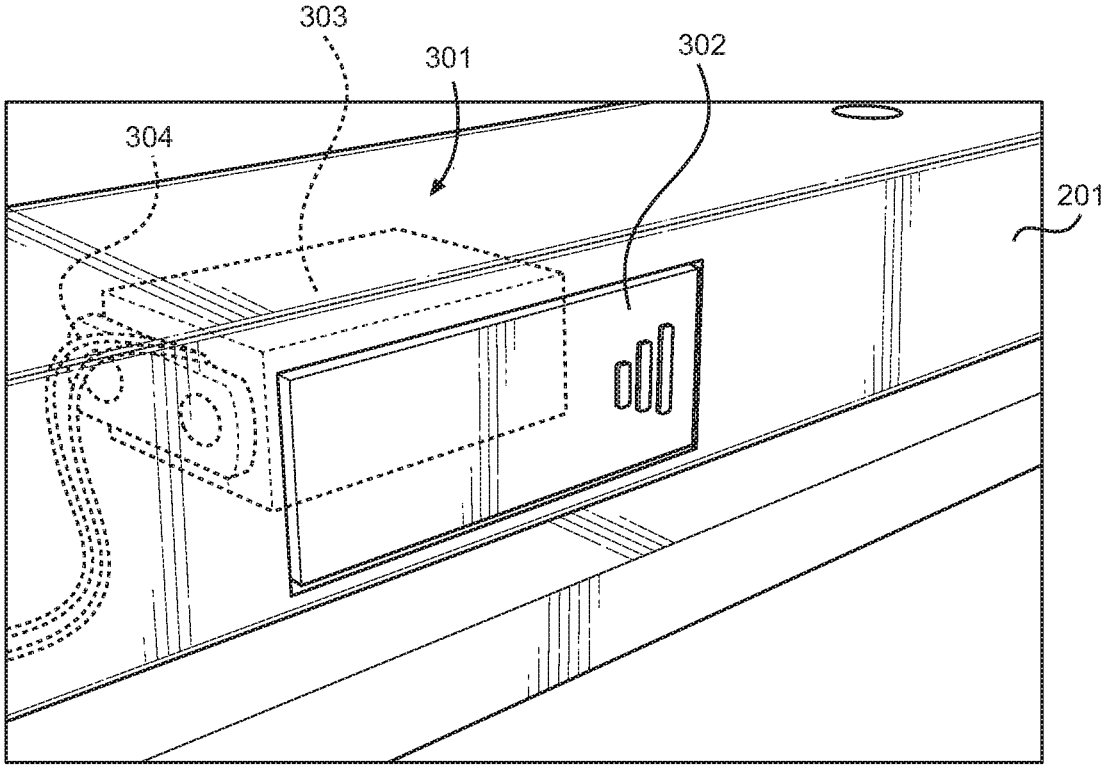
FIG. 3 shows a zoomed view of an embodiment of the battery compartment of the forklift mast warning alarm.

Referring now to FIG. 3, there is shown a zoomed view of an embodiment of the battery compartment of the forklift mast warning alarm. The battery compartment 301 is located in the horn bar 201. The battery compartment 301 is configured to house a plurality of batteries 303. In one embodiment the battery compartment 301 is further configured to house a fuse system 304. The battery compartment 301 is closes using a lid 302. In one embodiment the lid 302 slides into a locked position. In a second embodiment the lid 302 has a clip holding it in a closed position.

In another embodiment the forklift mast warning alarm is coupled directly to the forklifts power source. In this embodiment there is still a fuse located in the battery compartment 301. This embodiment will ensure that there will always be power supplied to the forklift mast warning alarm when the forklift has power.

Figure 4:
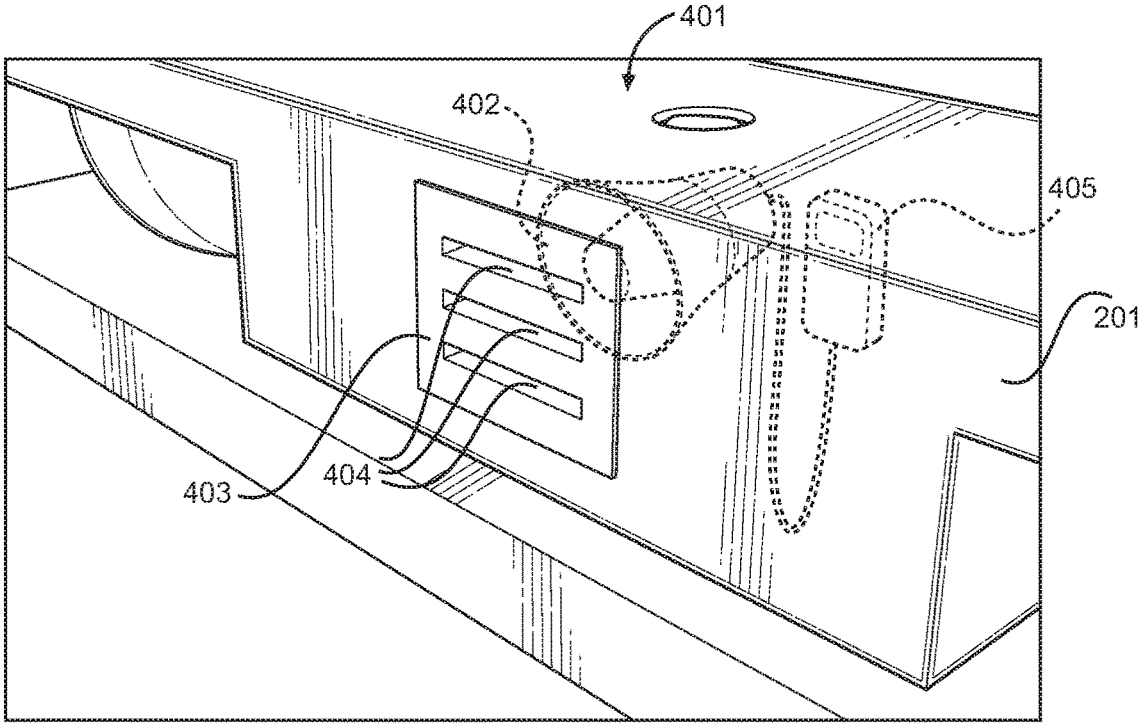
FIG. 4 shows a zoomed view of an embodiment of the horn compartment of the forklift mast warning alarm.

Referring now to FIG. 4, there is shown a zoomed view of an embodiment of the horn compartment of the forklift mast warning alarm. There is a horn compartment 401 located in the horn bar 201. The horn compartment has an interior volume that will fit at least a horn device 402 therein. The horn compartment 401 is configured to house a horn device 402. There is a horn compartment cover 403 which is removably secured to the horn bar 201. In one embodiment the horn compartment cover 403 is secured using a screw. The horn compartment cover 403 has a series of holes 404 located therein, these holes 404 allow for sound waves to better exit the horn compartment.

In one embodiment the horn device 402 is an actual horn. The horn may be an air horn, an electric horn or other suitable type of horn. In another embodiment the horn device 402 is a speaker. The speaker is not limited to horn sounds. In an embodiment where the horn device 401 is a speaker the horn compartment 401 also houses an MP3 player or other media player 405. In an embodiment where the horn device 401 is a speaker the media player 405 may be located by the drive to allow for a selection of sounds. Further, in this embodiment the horn device 401 may be placed by the drive to help ensure that the horn device 401 is easily heard even in noisy environments.

Figure 5:
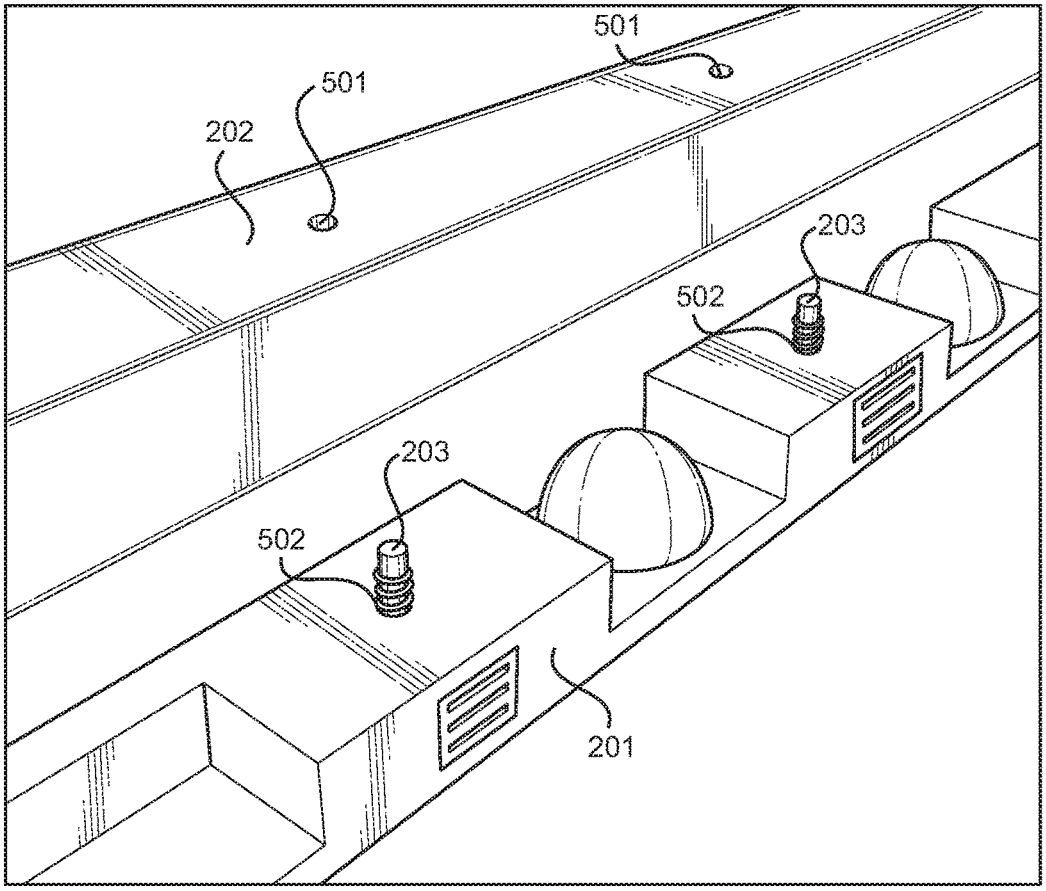
FIG. 5 shows an upside-down view of an embodiment of the horn bar of the forklift mast warning alarm.

Referring now to FIG. 5, there is shown an upside-down view of an embodiment of the horn bar of the forklift mast warning alarm. In one embodiment there are holes 501 that go through the contact bar 202. In this embodiment the contacts 203 complete the circuit when they come in contact with the forklift guard. In another version of this embodiment there may be a contact plate that will complete the circuit. This contact plate extends across the bottom surface of the contact bar 202.

In another embodiment the holes 501 do not go all the way through the contact bar 202. In this embodiment there are additional contacts placed in the holes. These contacts are connected together such that the circuit will be competed when the contacts in the horn bar 201 touch the contacts 203 in the contact bar 202.

In one embodiment there are springs 502 placed around the contacts 203. These springs 502 will serve the purpose of further biasing the horn bar 201 away from the contact bar 202. The springs 502 also help to protect the contacts 203. In one embodiment the springs 502 are configured to be powerful enough to replace the pressure sensors. In this embodiment a spring 502 disposed around each contact 203 will be enough to provide the proper bias to the horn bar 201.

Figure 6:
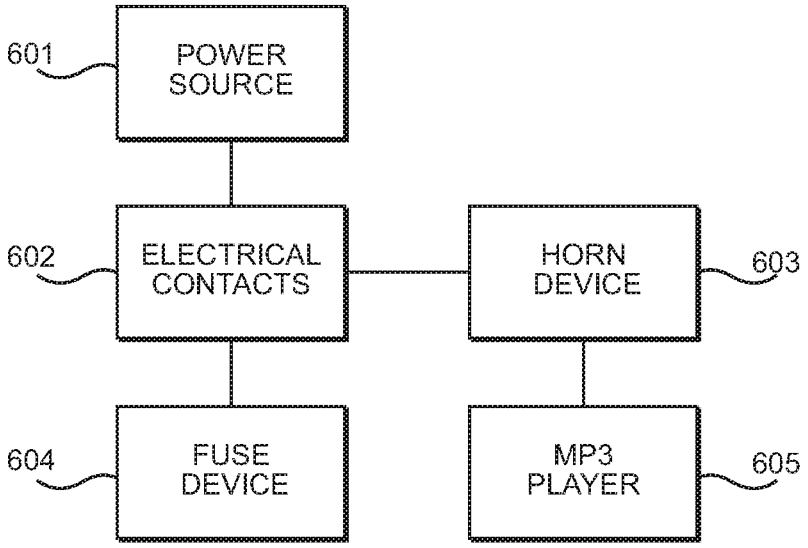
FIG. 6 shows a diagram of an embodiment of the circuitry of the forklift mast warning alarm.

Referring now to FIG. 6, there is shown a diagram of an embodiment of the circuitry of the forklift mast warning alarm. The circuitry includes a power source 601. In one embodiment the power source is at least one battery. The power source 601 is coupled to the electrical contacts 602. In one embodiment there is a fuse device 604 also included. A horn device 603 or other noise making implement is coupled to the electrical contacts 602 and the power source 601. This should be done such that the horn device 603 will sound when the electrical contacts 602 touch. In one embodiment an MP3 player 605 may be attached to the horn device 603 for playing sounds through the horn device 603.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A forklift mast warning alarm comprising; a horn bar movably attached to a contact bar; wherein the contact bar is configured to be attached to an upper end of a forklift mast frame; at least one electrical contact disposed along the horn bar; holes disposed within the contact bar corresponding to the at least one electrical contact; springs disposed around the at least one electrical contact such that the horn bar is biased away from the contact bar; a horn device attached to the horn bar; horn circuitry configured to activate the horn device when the horn bar is pressed down and the at least one electrical contact is engaged completing the horn circuitry.

2. The forklift mast warning alarm of claim 1, further comprising: a power source attached to the horn circuitry.

3. The forklift mast warning alarm of claim 2, wherein, the power source is a battery.

4. The forklift mast warning alarm of claim 2, wherein, the power source comes from the forklift.

5. The forklift mast warning alarm of claim 3, further comprising a compartment disposed along the horn bar configured to store the battery.

6. The forklift mast warning alarm of claim 1, further comprising a compartment disposed along the horn bar configured to store the horn device.

7. The forklift mast warning alarm of claim 1, wherein, the edges of the horn bar are beveled.

8. The forklift mast warning alarm of claim 1, wherein, the horn has a decibel level of between 80 and 120.

9. The forklift mast warning alarm of claim 6, further comprising:

an MP3 player disposed within the compartment configured to store the horn device.

10. The forklift mast warning alarm of claim 6, wherein the horn device is a speaker.

11. The forklift mast warning alarm of claim 6, wherein the horn device is an air horn.

* * * * *